US008413770B1

(12) United States Patent
Heyden et al.

(10) Patent No.: US 8,413,770 B1
(45) Date of Patent: Apr. 9, 2013

(54) SYSTEMS AND METHODS FOR RETARDING THE SPEED OF A RAILCAR

(75) Inventors: Thomas J. Heyden, Arlington Heights, IL (US); Gregory P. Reitz, Silver Lake, WI (US); Kurt J. Penney, Lexington, SC (US)

(73) Assignee: AAA Sales & Engineering, Inc., Oak Creek, WI (US)

( * ) Notice: Subject to any disclaimer, the term of this patent is extended or adjusted under 35 U.S.C. 154(b) by 579 days.

(21) Appl. No.: 12/349,753

(22) Filed: Jan. 7, 2009

Related U.S. Application Data

(60) Provisional application No. 61/048,835, filed on Apr. 29, 2008.

(51) Int. Cl.
*B61K 7/02* (2006.01)

(52) U.S. Cl. ..... 188/62; 104/26.2

(58) Field of Classification Search ..... 188/62; 104/26.2, 256

See application file for complete search history.

(56) References Cited

U.S. PATENT DOCUMENTS

| | | | | |
|---|---|---|---|---|
| 3,519,107 | A * | 7/1970 | Bellinger | 188/62 |
| 3,621,942 | A * | 11/1971 | Danieli | 188/62 |
| 3,926,124 | A * | 12/1975 | Frank | 104/26.2 |
| 4,098,374 | A * | 7/1978 | Frank | 188/62 |
| 4,307,916 | A * | 12/1981 | Straut et al. | 303/9.76 |
| 4,393,960 | A | 7/1983 | Mazur et al. | |
| 4,967,511 | A | 11/1990 | Werginz et al. | |
| 4,996,793 | A | 3/1991 | Mazur | |
| 6,152,042 | A * | 11/2000 | Barry et al. | 104/26.2 |
| 6,216,525 | B1 | 4/2001 | Bernd et al. | |
| 6,422,519 | B1 | 7/2002 | Braatz | |
| 7,140,698 | B2 | 11/2006 | Braatz et al. | |
| 7,306,077 | B2 | 12/2007 | Heyden et al. | |
| 7,325,567 | B2 | 2/2008 | Heyden et al. | |
| 7,392,887 | B2 | 7/2008 | Heyden et al. | |
| 2008/0237511 | A1 | 10/2008 | Heyden et al. | |

FOREIGN PATENT DOCUMENTS

EP 1122144 A1 * 8/2001

* cited by examiner

*Primary Examiner* — Bradley King
(74) *Attorney, Agent, or Firm* — Andrus, Sceales, Starke & Sawall, LLP

(57) ABSTRACT

Systems and methods for retarding the speed of a railcar are provided. A supply of pressurized hydraulic fluid is provided to a piston cylinder to actuate the cylinder and thereby move a brake into a closed position in which the brake will apply a predetermined braking pressure to a wheel of the railcar. An accumulator accumulates fluid from the circuit when the wheel forces the brake out of the closed position and supplies accumulated fluid back to the circuit as the brake moves back into the closed position to thereby maintain a substantially constant braking pressure on the wheel as it moves through the retarder.

4 Claims, 3 Drawing Sheets

SYSTEMS AND METHODS FOR RETARDING THE SPEED OF A RAILCAR

CROSS-REFERENCE TO RELATED APPLICATION

This application claims priority of U.S. Provisional Patent Application No. 61/048,835, filed Apr. 29, 2008, which application is incorporated herein by reference.

FIELD

This application relates generally to retarders of the kind suitable for reducing the speed of a railcar riding along a set of rails. More particularly, this application relates to electro-hydraulic railcar retarders and methods for controlling the speed of a railcar.

BACKGROUND

Retarders are commonly used in railway classification yards, wherein railcars are caused to accelerate down a raised profile or hump towards a particular destination. As the railcars accelerate down the hump, the retarder applies braking pressure on the wheels of the railcar to prevent accidents or derailment and yet maintain a predetermined speed of travel of the railcar. Many different types of electro-hydraulic, air and mechanical retarders are known in the art, some examples of which are disclosed in U.S. Pat. Nos. 4,393,960 and 7,140,698, the disclosures of which are incorporated herein by reference.

Known air retarders are generally more robust and efficient than electro-hydraulic retarders. However railyard operators that already employ electro-hydraulic retarders have found the prospect of changing over to an air retarder system to be cost-prohibitive, especially because of the significant capital investment necessary to install an air plant. Also, these operators do not want to lose the significant amount of capital investment already made in equipment associated with the electro-hydraulic retarders, for example the battery back-up necessary to power the hydraulic retarders for a short period of time in the event of a power outage.

The applicant has therefore recognized that there is currently a significant need in the art for more efficient and effective electro-hydraulic retarder systems and methods of operating such systems.

Current electro-hydraulic retarders contain multiple sets of levers and brake shoes. A hydraulic piston cylinder activates an elaborate mechanical linkage to translate and rotate the levers to close the brake shoes to a width that is narrower than the width of the railcar wheel. When the wheel enters the retarder, the retarder must be capable of allowing the brake shoes to spread apart to the width of the wheel and yet still maintain the desired pressure on the side of the wheel; and the retarder must also allow for quick application and removal of pressure on the sides of the wheel. However because hydraulic system fluids are generally incompressible, it is currently difficult to use hydraulics to power a set of brake shoes in such a way that the brake shoes will quickly spread apart to accept an entering wheel and conform to the various widths of railcar wheels while maintaining a consistent pressure on the side of the wheel.

In addition, current electro-hydraulic retarders have many metal-on-metal wear surfaces and complicated linkage systems that require regular maintenance. These retarders do not meet life expectations and are difficult to repair.

SUMMARY

The present application describes systems for and methods of operating electro-hydraulic retarders. The concepts described herein overcome many problems associated with prior art electro-hydraulic retarders, while using the same power source already existing at most railyards currently employing electro-hydraulic retarder systems.

In one particular example, a system is provided for retarding the speed of a railcar. The system includes a brake, a hydraulic actuator coupled to the brake, and a hydraulic circuit that directs pressurized hydraulic fluid to the actuator. The fluid causes the actuator to move the brake towards a closed position in which the brake will apply a predetermined braking pressure on a wheel of the railcar. A hydraulic accumulator is coupled to the circuit and configured to accumulate fluid from the circuit when the wheel forces the brake out of the closed position and to supply pressurized accumulated fluid back to the circuit when the brake moves back into the closed position to thereby maintain a substantially constant braking pressure on the wheel of the railcar as it moves through the brake.

In another example, the system includes a pair of brake shoes that are configured to apply braking pressure to both sides of the wheel of the railcar. The brake shoes are each connected to a lever. The levers pivot about a common axis to move the brake shoes towards each other and toward a closed position in which the brake shoes will apply a predetermined braking pressure on the wheel of the railcar. A hydraulic piston cylinder is coupled to each lever in the pair and is configured to cause the pivoting movement of the lever towards the other lever in the pair. A hydraulic circuit directs pressurized fluid to the piston cylinders to cause the piston cylinders to move the brake shoe towards the closed position. A pump is controlled by a controller to supply a selected amount of pressurized fluid to the circuit. A pressure control valve is coupled to the circuit and operated by the controller to maintain the pressurized fluid in the circuit within a predetermined pressure range. A hydraulic accumulator is coupled to the circuit and configured to accumulate fluid from the circuit when the wheel forces the brake away from the closed position and to supply accumulated fluid back to the circuit when the brake moves back into the closed position.

In another example, a method for controlling the speed of a railcar is provided. In a first step, a supply of pressurized hydraulic fluid is provided to a piston cylinder to actuate the cylinder and thereby move a brake into a closed position in which the brake will apply a predetermined braking pressure to a wheel of the railcar. Thereafter, an accumulator is operated to accumulate fluid from the circuit when the wheel forces the brake shoe out of the closed position and to supply accumulated fluid back to the circuit as the braking shoe moves back into the closed position.

BRIEF SUMMARY OF THE DRAWINGS

The best mode of carrying out the invention is described herein with reference to the following drawing figures.

DETAILED DESCRIPTION OF THE DRAWINGS

In the following description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configuration, systems and method steps. The following description relates to the best mode of the invention and it is therefore to be understood that various equivalents, alternative and modifications are possible within the scope of the appended claims.

Figure 1:
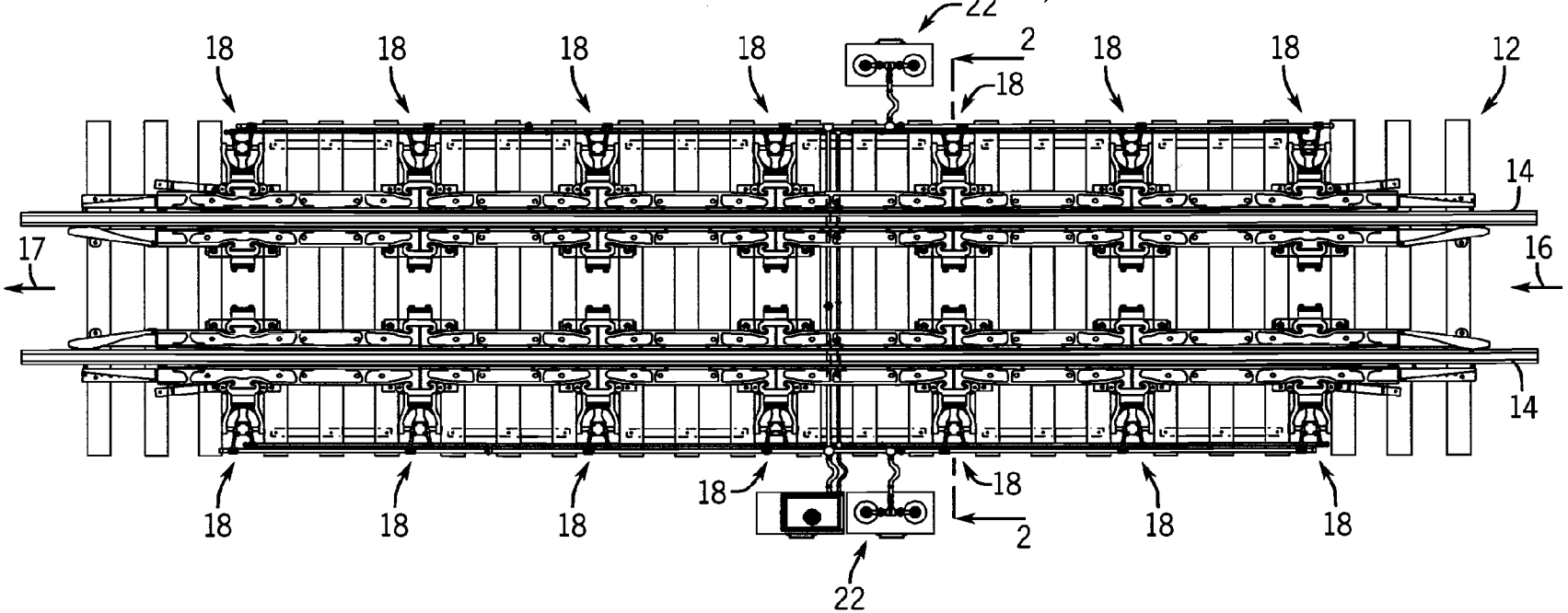
FIG. 1 is a top view of one example of a system for retarding the speed of a railcar.

FIG. 1 shows a railcar retarder system 10 that is mounted along a section of track 12 that includes a pair of conventional rails 14. It should be understood that the track 12 continues in both directions from the system 10 with railcars entering the system 10 from the right in the direction shown by arrow 16 and exiting to the left in the direction shown by arrow 17. The system 10 includes a series of pairs of retarders 18 positioned on opposite sides of each of the rails 14. As is conventional, the retarders 18 are positioned alongside and on top of the rails 14 such that, when actuated, the retarders 18 engage the sides of the railcar wheels to brake or retard the moving railcar.

Figure 3:
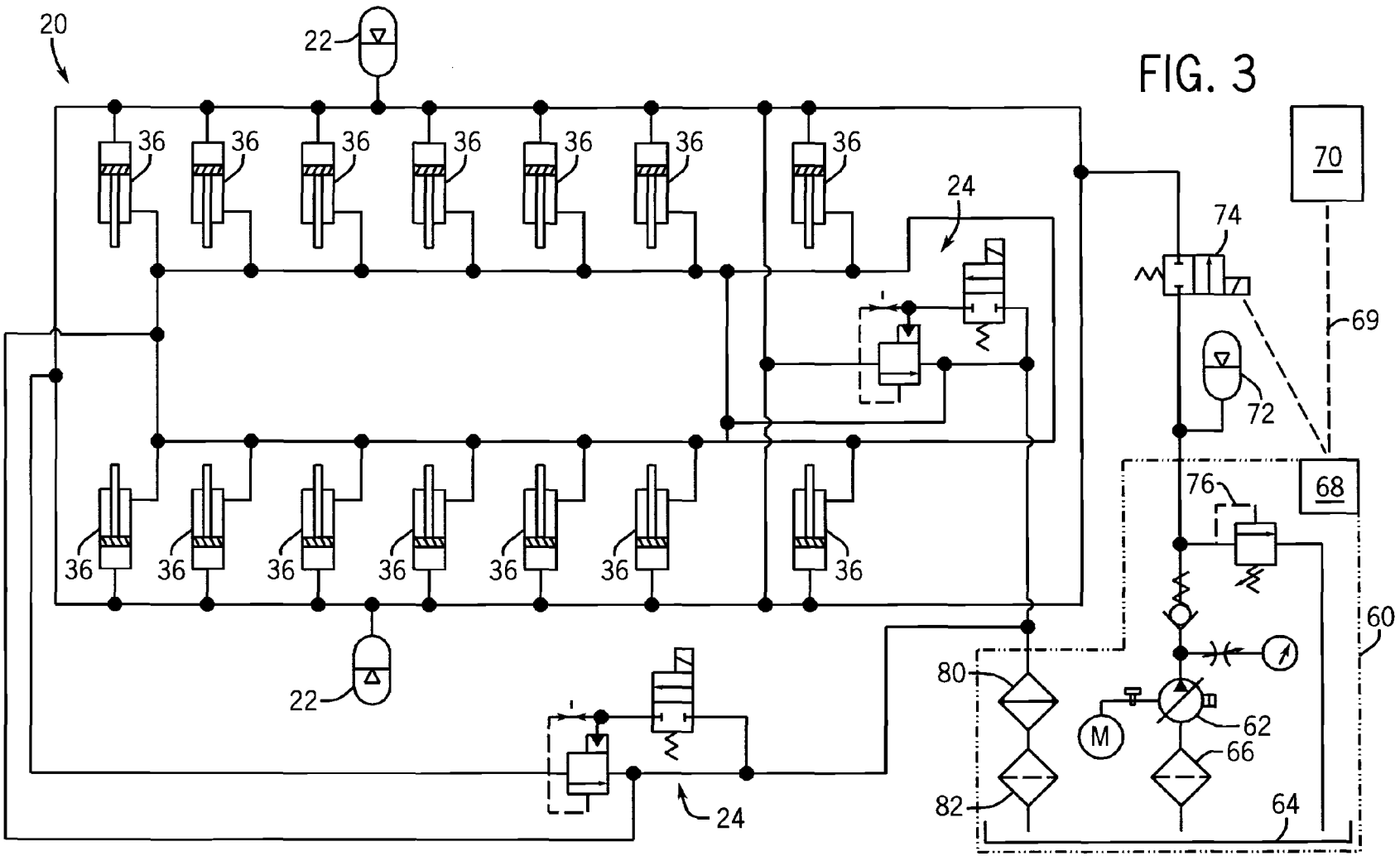
FIG. 3 is a schematic view of one example of a hydraulic circuit for the system.

The system 10 shown includes seven pairs of retarders 18 that are connected in series to a hydraulic circuit 20 (shown in detail in FIG. 3). The hydraulic circuit 20 receives and directs pressurized hydraulic fluid to the retarders 18 to actuate the retarders 18 as further discussed below. Hydraulic accumulators 22 and pressure relief valves 24 (shown in detail in FIG. 3) are connected to the hydraulic circuit 20. The function of the accumulators 22 and valves 24 will be described further below with reference to FIG. 3. Although the particular example shown depicts a series of seven pairs of retarders 18, two accumulators 22, and two pressure relief valves 24, it should be recognized that the number and arrangement of the retarders 18, accumulators 22 and pressure relief valves 24 can vary from that shown depending upon various operational parameters.

Figure 2:
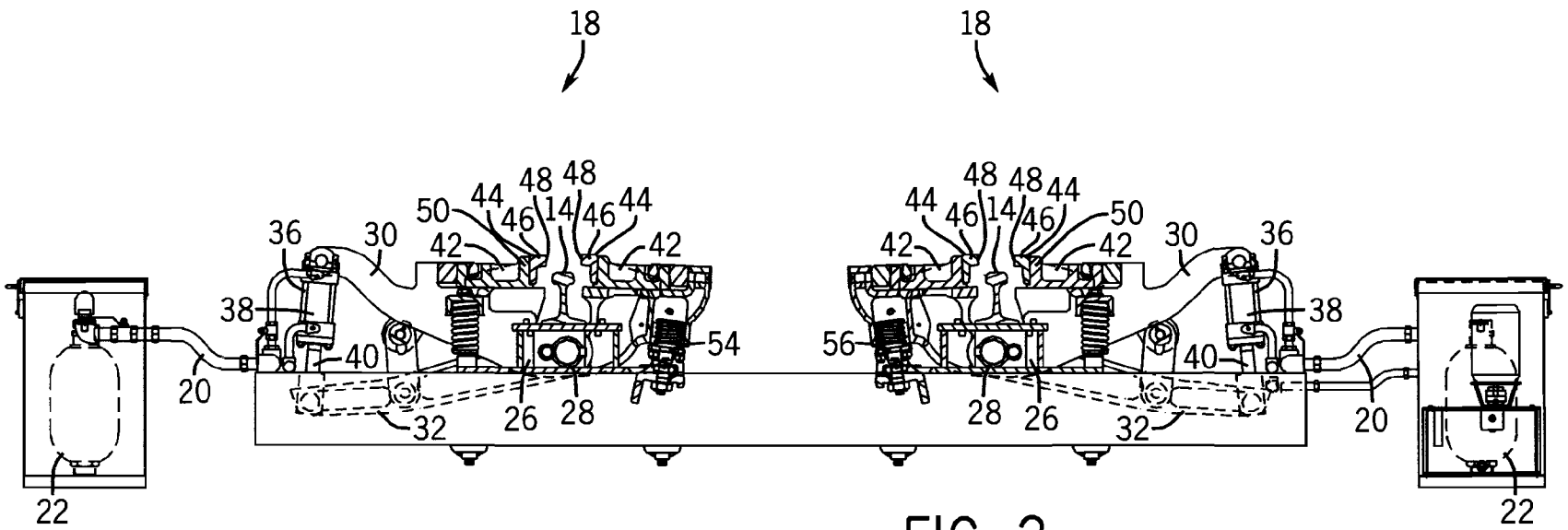
FIG. 2 is a view of Section 2-2 taken in FIG. 1.

FIG. 2 shows a view of Section 2-2 taken in FIG. 1. This view is representative of each pair of retarders 18 in the system 10. Each retarder 18 includes rail supports 26 to which rail 14 is secured. Each rail support 26 contains a fulcrum pin 28 supporting upper and lower levers 30, 32. A pin 28 passes through an end of upper lever 30 and through a center portion of lower lever 32. A hydraulic piston cylinder 36 has a cylinder 38 connected to the end of one of the levers 30, 32 and a piston rod 40 connected to the other.

A brake beam 42 is secured to each of the levers 30 and 32. The position of the brake beam 42 on the levers 30, 32 may be adjusted by an adjustment mechanism extending through flanges on the lever arms, according to known arrangements such as those described in U.S. Pat. No. 4,393,960.

Brake shoes 44 are mounted on the brake beams 42. The brake shoes 44 are generally L-shaped in cross section having a short arm 46 containing braking surface 48 supported by flange 50 mounted to brake beam 42.

When it is desired to retard the motion of a railcar riding on rails 14, hydraulic fluid is provided to the piston cylinder 36 via the circuit 20 to actuate the piston cylinder 36 to extend piston rod 40. The piston cylinder 36 pivots the ends of levers 30 and 32 apart and thus moves brake shoes 44 towards each other and into contact with a car wheel 52. Brake shoes 44 contact the inside and outside of a railcar wheel riding on the rail to apply a braking pressure. To decrease or terminate the retarding action, the fluid pressure on the piston cylinder 36 is decreased and the return springs 54, 56 and the weight of upper lever 30 move the ends of levers 30 and 32 apart and thus move brake shoes 44 out away from the railcar wheel.

FIG. 3 depicts one example of a hydraulic circuit 20 that directs pressurized hydraulic fluid to each of the seven pairs of piston cylinders 36 shown in FIG. 1. A power unit 60 is connected to the circuit 20 and includes a pump 62, filter 66 and tank 64 for storing hydraulic fluid, such as oil. Preferably, the pump 62 is a 28 gallon per minute variable displacement pump; however other pumps and pump rates can be used. The pump 62 draws hydraulic fluid through the filter 66 from the tank 64 and pumps the hydraulic fluid into the circuit 20.

A process control system, referred to hereinafter as a yard controller 70, communicates via a wired or wireless link 69 with a microprocessor or controller 68 located at the power unit 60. As a railcar approaches the retarder system 10, the yard controller 70 monitors various environmental factors and/or characteristics of the railcar such as its weight, velocity, direction, and the like, and thereafter calculates an amount of braking pressure necessary to achieve a desired railcar speed. Based upon this calculation, the yard controller 70 commands the power unit controller 68 to operate the pump 62 to achieve the braking pressure. Breaking pressure is typically defined in the art in terms of prescribed weight classes, which are well known in the art. An example of typical weight classes are provided below.

| | |
|---|---|
| LIGHT | 262-394 psi |
| MEDIUM | 657-788 psi |
| HEAVY | 1051-1182 psi |
| EXTRA HEAVY | 1445-1576 psi |

Increasing the amount of hydraulic fluid pressure in the hydraulic circuit 20 causes the piston cylinders 36 to extend, thereby closing the brake shoes 44 and increasing the amount of braking pressure on the wheels of the railcar, as described above. Decreasing the amount of hydraulic fluid pressure in the hydraulic circuit 20 causes the piston cylinders to retract, thereby allowing the brake shoes 44 to spread apart and decrease the braking pressure on the wheels of the railcar, as described above.

In the example shown in FIG. 3, an accumulator 72 and a directional flow control valve 74 are coupled to the hydraulic circuit 20 between the pump 62 and the piston cylinders 36. The accumulator 72 can be of any one of a variety of known hydraulic accumulators, such as a compressed gas or gas-charged accumulator or the like. In the example shown, the accumulator 72 includes a cylinder with two chambers that are separated for example by an elastic diaphragm, a totally enclosed bladder, or a floating piston. One chamber contains hydraulic fluid and is connected to the hydraulic circuit 20. The other chamber contains an inert gas under pressure or "precharge" that provides a compressive force on the hydraulic fluid in the circuit 20. The flow control valve 74 can consist of any one of a variety of directional control valves capable of moving between an open position wherein flow of hydraulic fluid from the pump 62 to the piston cylinders 36 is allowed and a closed position wherein flow of hydraulic fluid from the pump 62 to the piston cylinders 36 is not allowed.

The accumulator 72 and flow control valve 74 are designed to provide a quick application of hydraulic fluid pressure to the circuit 20. More specifically, the flow control valve 74 is controlled by either the yard controller 70 or power unit controller 68 to move between the open and closed positions. While the control valve 74 is in the closed position, the accumulator 72 stores pressurized hydraulic fluid provided by the pump 62. When the control valve 74 is moved into the open position, the pressurized fluid in the accumulator 72 is provided to the circuit 20 and ultimately to the piston cylinders 36. This arrangement allows for use of a less powerful motor to drive the pump, thus saving cost to the railyard owner. In an alternate example, the accumulator 72 and flow control valve 74 can be eliminated and thus the power unit controller 68 would operate the pump 62 directly based upon the signal from the yard controller 70. Although this alternate arrangement would likely not be as efficient and responsive as the above described arrangement including the accumulator 72 and flow control valve 74, it would achieve the necessary results.

Two hydraulic accumulators 22 are coupled to the hydraulic circuit 10. The number of hydraulic accumulators 22 can vary and the accumulators 22 could include any one of a variety of known hydraulic accumulators, such as a compressed gas or gas-charged accumulator or the like. In the example shown, the accumulators 22 include a cylinder with two chambers that are separated by for example an elastic diaphragm, a totally enclosed bladder, or a floating piston. One chamber contains hydraulic fluid and is connected to the hydraulic circuit 20. The other chamber contains an inert gas under pressure that is precharged to provide a compressive force on the hydraulic fluid in the circuit 20. The accumulators 22 are distributed at separate locations in the circuit 20; however the accumulators 22 could also or alternatively be connected to the circuit via a common header. Alternatively, the accumulators 22 can be connected to the circuit 20 by a valve, such as a hydraulically piloted directional control valve that is controlled by the yard controller 70 or power unit controller 68 to open and close depending upon the amount of breaking pressure requested by the yard controller 70.

During operation, the accumulators 22 allow the brake shoes 44 to quickly spread apart to accept an entering rail car wheel and to conform to the various widths of railcar wheels while maintaining a consistent pressure on the side of the wheel. The accumulators 22 allow the retarder 18 to accept wheels of different thicknesses and yet quickly apply a relatively constant braking pressure to the wheels. Specifically, as the wheels of the railcar enter the retarder 18 in the direction of arrow 16 and push the brake shoes 44 apart, the piston cylinders 36 of the first pair of retarders 18 are collapsed and the hydraulic fluid in the circuit is forced into the accumulators 22 against the bias force of the pre-charge in the accumulators 22. When the force of the wheel on the brake shoes 44 exceeds the pre-charge, the accumulator 22 accumulates fluid from the circuit 20 and the brake shoes 44 are allowed to spread apart. Thus the accumulators 22 will either accept hydraulic fluid from the circuit 20 or provide hydraulic fluid to the circuit to maintain a substantially constant force on the break shoes 44. As the wheels pass through the first pair of retarders 18 and then engage the next pair of retarders 18, the brake shoes 44 on the first pair of retarders 18 will be forced back into a closed position by the precharge of the accumulators 22 and by the increase in pressure in the circuit 22 caused when the wheels force the brake shoes 44 apart on the second pair of retarders 18. Therefore, the accumulators 22 maintain a substantially constant breaking pressure on the wheels by taking in hydraulic fluid and discharging hydraulic fluid in a waveform-like manner as the wheels move from retarder 18 to retarder 18 through the system 10.

The number and configuration of the accumulators 22 can vary according to the objectives described here. It is preferable to size the accumulator(s) 22 large enough to handle the displacement of hydraulic fluid that is forced out of the piston cylinders when the piston cylinders are compressed; this displacement occurring when the intended hydraulic pressure may be as great as 2000 psi. Once the hydraulic fluid has been directed back into the accumulators 22, the pressure must not exceed the brake shoe braking force that would derail a railcar. The accumulators 22 are preferably precharged to a value that correlates to the LIGHT weight class. However it is possible to precharge one accumulator 22 to handle the LIGHT and MEDIUM weight classes and the other accumulator 22 to handle the HEAVY and EXTRA HEAVY weight classes. Alternatively for example it is possible to include four accumulators, one accumulator for each weight class.

A pair of pressure relief valves 24 are disposed in the hydraulic circuit 20 and set to open when the pressure in the hydraulic circuit 20 exceeds a predetermined pressure. In the example shown, the relief valves 24 are hydraulically piloted, however any other type of relief valve can be used as long as it can be set to open when the pressure in the hydraulic circuit 20 exceeds a predetermined pressure. The relief valves 24 are located downstream of the retarders 18 and upstream of a heat exchanger 80 and filter 82 leading back to the tank 64. However it should be recognized that the number and location of the relief valves 24 can vary from that shown in FIG. 3. One or more relief valves 24 can be located upstream and/or downstream of the piston cylinders 36, for example.

When the pressure relief valves 24 are opened, hydraulic fluid located upstream of the valves 24 is allowed to flow into the rod side of the piston cylinders 36 and also back to the tank via the heat exchanger 80 and filter 82. Typically the fluid will first flow to the rod side of the piston cylinders 36 because displacement of the rod 40 causes a vacuum inside the circuit 20. This advantageously aids in a quicker acting piston cylinder 36 and serves to reduce flow rates back to the tank 64 for any single stroking of the piston cylinder 36. The excess fluid is recycled fluid back to the tank 64 via the heat exchanger 80 and filter 82 for regeneration.

Preferably, the yard controller 70 communicates with and controls the relief valves 24 to open when the pressure in the circuit 20 exceeds a certain value. For example, if the yard controller 70 commands the power unit controller 68 to operate at a medium weight class, the relief valves 24 are preferably also commanded to open once the pressure inside the circuit 20 attains a value that is above the normal operating range for the medium weight class.

As the railcar wheels move through the system 10, the yard controller 70 preferably continuously monitors the speed of the railcar and issues commands to the power unit controller 68 and/or the valve 74 to call for more or less hydraulic fluid and thus more or less retardation. Commands are also issued to the control valves 24 to set the prescribed pressure relief, as described above. According to the depicted embodiment, the pump 62 is continuously applying fluid into the system and operation of the valve 74 and/or accumulator determines the amount of pressure added to the circuit 20.

Another advantage of the systems and methods described herein is that it is possible to heat or cool the system 10 as needed. To cool the system, the power unit controller 68 sends a command to open the relief valves 24 or to otherwise set the relief valves 24 to a setting that presents minimal flow restriction. Thus very little heat will be generated as the hydraulic fluid circulates through the relief valves 24. Operation of the pump 62 causes the hydraulic fluid to flow through the circuit 20 and through the heat exchanger 80, thus cooling the system 10. To warm the system, the power unit controller 68 sends a command to close the relief valves 24 or to otherwise set the relief valves 24 to a setting that presents a large amount of flow restriction. Operation of the pump 62 causes a buildup of pressure in the circuit 20 and causes the hydraulic fluid to flow across the highly restrictive relief valves 24, generating a large amount of heat, with heats the system.

In the example shown and described, each retarder 18 will be able to move between any weight class other than the fully opened position in less than 0.5 seconds (e.g. LIGHT to MEDIUM or LIGHT to EXTRA HEAVY in 0.5 seconds). However, if the cylinders collapse to allow a true open condition, it will take approximately 15 seconds (10 gpm pump on a 10 horsepower motor) to refill the piston cylinder 36 to obtain a LIGHT weight class. This issue can be addressed by never truly opening the retarder 18. Instead, the retarder 18 can go to a 60 psi state. The brake shoes 44 will still be closed, piston-cylinders 36 extended. However, there will be little pressure on the wheel (similar to the release of an automobile caliper brake). As long as the 2.569 gallons (0.12 gallons per cylinder for a 3¼-inch diameter cylinder stroking 3.375 inches) of oil is not drained from the 14 cylinders, the unit will be able to respond to a weight class call in less than 0.5 seconds. A true OPEN weight class could be added for retarder maintenance and trim operations. Adding such a weight class would effect seamless integration with the yard process control system.

It is possible to shorten the time for transitioning from a full OPEN state to a CLOSED state by reducing the travel of the brake shoe. On a standard pneumatic retarder, the brake shoes move from a 6-inch open position to a 5-inch closed position to clamp on a wheel that is 5.7188 plus or minus 0.125 inches (5.8438/5.5938) thick. Reducing the travel from 6-inch open to a dimension greater than 5 inches will reduce cylinder stroke and the time required to move from a true OPEN position to a CLOSED position.

It is possible to reduce the time for transitioning from a full OPEN state to a CLOSED state by reducing cylinder diameter and increasing operating pressure. This will require upgrading the hydraulic system to a higher pressure. This increases responsiveness and cost. The maximum system pressure/cylinder diameter, will be determined by railyard operation considerations.

It is possible to reduce the time for transitioning from a full OPEN state to a CLOSED state by increasing accumulator 72 size. The more energy this accumulator stores, the more quickly the retarder will close. Again, this increases responsiveness and cost. The size of the accumulator will be determined by railyard operation considerations.

What is claimed is:

1. A system for retarding the speed of a railcar, the system comprising:

a brake;

a hydraulic piston cylinder that causes movement of the brake, the piston cylinder having a rod side and a cylinder side;

a pump pumping hydraulic fluid from a reservoir to the piston cylinder;

a hydraulic circuit having a first section that conveys hydraulic fluid from the pump to the piston cylinder to move the brake towards a closed position in which the brake will apply a braking pressure on a wheel of the railcar;

wherein the circuit further has a second section that returns hydraulic fluid from the piston cylinder to the reservoir;

a first hydraulic accumulator that accumulates hydraulic fluid from the first section of the circuit when the wheel forces the brake out of the closed position and supplies accumulated hydraulic fluid back to the circuit when the brake moves back into the closed position to thereby maintain braking pressure on the wheel of the railcar as it moves through the brake;

a pressure relief valve coupled to the second section of the circuit, the pressure relief valve being positionable in an open position wherein hydraulic fluid is allowed to flow from one of the rod side and the cylinder side of the piston cylinder to both of the reservoir and the other of the rod side and the cylinder side of the piston cylinder, the pressure relief valve also being positionable in a closed position wherein flow of hydraulic fluid from the one of the rod side and the cylinder side of the piston cylinder to both of the reservoir and the other one of the rod side and cylinder side of the piston cylinder is prevented; and a microprocessor selectively controlling movement of the pressure relief valve into the closed position to and into the open position to thereby quickly control the amount of braking pressure applied by the brake to the wheel of the railcar.

2. A system according to claim 1, wherein the first hydraulic accumulator comprises one of a plurality of hydraulic accumulators accumulating hydraulic fluid from the first section of the circuit when the wheel forces the brake out of the closed position and supplying accumulated hydraulic fluid back to the circuit when the brake moves back into the closed position to thereby maintain a substantially constant braking pressure on the wheel of the railcar as it moves through the brake.

3. A system according to claim 2, wherein each accumulator in the plurality of hydraulic accumulators is precharged to a different pressure.

4. A system according to claim 1, comprising a second hydraulic accumulator accumulating hydraulic fluid from the first section of the circuit and supplying the accumulated hydraulic fluid back to the circuit;

a control valve located in the first section of the circuit between the second accumulator and the first accumulator, the control valve positionable in a closed position wherein the hydraulic fluid from the pump is accumulated in the second accumulator and is not provided to the piston cylinder and positionable in an open position wherein hydraulic fluid from both the pump and the second accumulator is provided to the piston cylinder via the circuit; and wherein the microprocessor selectively controls movement of the control valve into the closed position to and into the open position to thereby quickly control the amount of braking pressure applied by the brake to the wheel of the railcar.

* * * * *